US005448863A

United States Patent [19]

Zapf

[11] Patent Number: 5,448,863

[45] Date of Patent: Sep. 12, 1995

[54] COVERED WALL UNIT AND METHOD OF MAKING SAME

[76] Inventor: Otto W. Zapf, Herzog-Adolph-Strasse 5, D-6240 Königstein, Germany

[21] Appl. No.: 206,440

[22] Filed: Mar. 4, 1994

[51] Int. Cl.[6] ..... E04B 1/00

[52] U.S. Cl. ..... 52/222; 52/275; 160/395

[58] Field of Search ..... 52/222, 144, 145, 716.3, 52/716.4, 238.1, 240, 273; 135/119, 120.3; 160/354, 380, 391, 395, 378, 402, 403

[56] References Cited

U.S. PATENT DOCUMENTS 4,233,790 11/1980 Meadows ..... 52/222
4,274,234 6/1981 Abell ..... 52/222 X
4,473,982 10/1984 Monari ..... 52/222
4,532,744 8/1985 Beneze et al. ..... 52/222
4,534,145 8/1985 Yang et al. ..... 52/222
4,665,670 5/1987 van den Burg ..... 52/222
4,665,671 5/1987 Sarvis ..... 52/222
4,677,795 7/1987 Mathews et al. ..... 52/222 X
4,887,626 12/1989 Dalo et al. ..... 52/222 X

*Primary Examiner*—Carl D. Friedman
*Assistant Examiner*—Beth A. Aubrey
*Attorney, Agent, or Firm*—Kirschstein, et al.

[57] ABSTRACT

A covered wall unit, especially suitable for use in office furniture applications, includes an upright structure having an outer, peripheral, open channel loosely surrounded by a tubular-shaped flexible cover. A tension bar is received in the channel for pushing the cover therein and tensioning the cover to lie taut against the structure.

10 Claims, 3 Drawing Sheets

COVERED WALL UNIT AND METHOD OF MAKING SAME

BACKGROUND OF THE INVENTION

1. Field of the Invention

This invention generally relates to a covered wall unit and a method of making the same.

2. Description of Related Art

It is known to insert either solid or apertured panels into tubular fabric covers in order to make a covered wall unit suitable for use in office furniture applications, such as, room dividers, sight and sound barriers, and so on, or for use in retail stores as display stands. Since it is desired to have the cover lie flat and taut against each panel, the inner dimensions of the known cover must correspond very closely to the outer dimensions of the known panel. This has the drawback that it is difficult to insert the panel into the tight-fitting cover. The tight-fitting cover is sometimes ripped by the sharp corners and linear edges on the panel.

In order to alleviate this problem, the art has proposed rounding the corners and the peripheral edges of the panel. This does help prevent rips, but experience has shown that manufacturing time and costs are still excessive. Also, rounded edges are not as desirable as planar edges in those applications where wide gaps between the edges of adjacent panels are unacceptable.

SUMMARY OF THE INVENTION

Objects of the Invention

It is an object of this invention to advance the state of the art of covered wall units.

Another object of this invention is to reduce the manufacturing effort involved in making a covered wall unit.

Yet another object of this invention is to reduce the manufacturing time and costs involved in the manufacture of such units.

An additional of this invention is to provide a novel method of making a covered wall unit.

Features of the Invention

In keeping with these objects and others which will become apparent hereinafter, one feature of this invention resides, briefly stated, in a covered wall unit, comprising an upright structure having an outer, peripheral, open channel. The structure may be a generally rectangular, one-piece panel having opposite, generally planar, major surfaces, or an apertured frame having frame elements bounding a central opening extending therethrough. The structure is constituted of a rigid material, lies in a plane and, preferably, has a generally quadrilateral shape.

A tubular-shaped cover loosely surrounds the structure and overlies the channel. Advantageously, the cover is an oversized tube constituted of a flexible material, such as fabric or cloth and, in the preferred embodiment, is a sewn tube having a longitudinal seam.

In accordance with this invention, tensioning means are receivable in the channel, and are operative for pushing the cover into the channel, and for tensioning the cover to lie taut against the structure. In the preferred embodiment, a channel-shaped border element is mounted on, and extends along, at least one peripheral linear edge of the structure, and the tensioning means includes a tension bar insertable in the channel of the border element. The tension bar presses against the cover and pushes the cover into the channel, thereby taking up slack in the oversized cover. Advantageously, the seam is positioned in the channel so that when the tension bar is positioned in the channel, the seam is concealed.

In the preferred embodiment, the tension bar has an outer planar surface that extends generally perpendicularly to the plane of the structure. Also, the border element has a pair of spaced-apart arms and a web extending between the arms. In one embodiment, the web is mounted on the structure, and the arms extend away from the structure. In another embodiment, one of the arms is mounted on the structure.

The use of an oversized, rather than a tight-fitting, cover greatly simplifies the manufacturing process. Rips are avoided. Manufacturing time and costs are greatly decreased—all without sacrificing the look of a tautly-covered wall unit.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
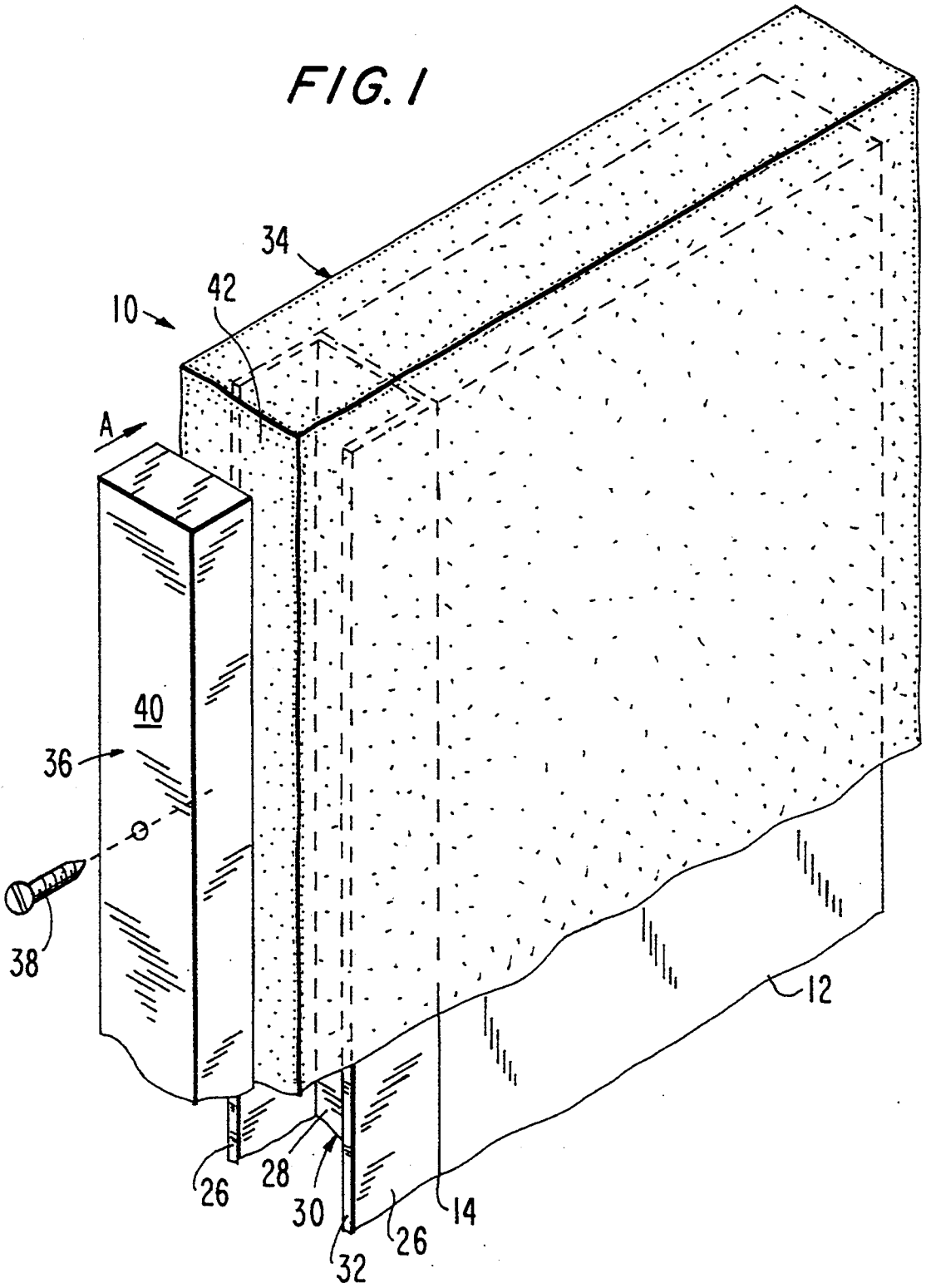
FIG. 1 is a partially broken-away, exploded, perspective view of a wall unit in accordance with one embodiment of this invention during its manufacture.
Figure 2:
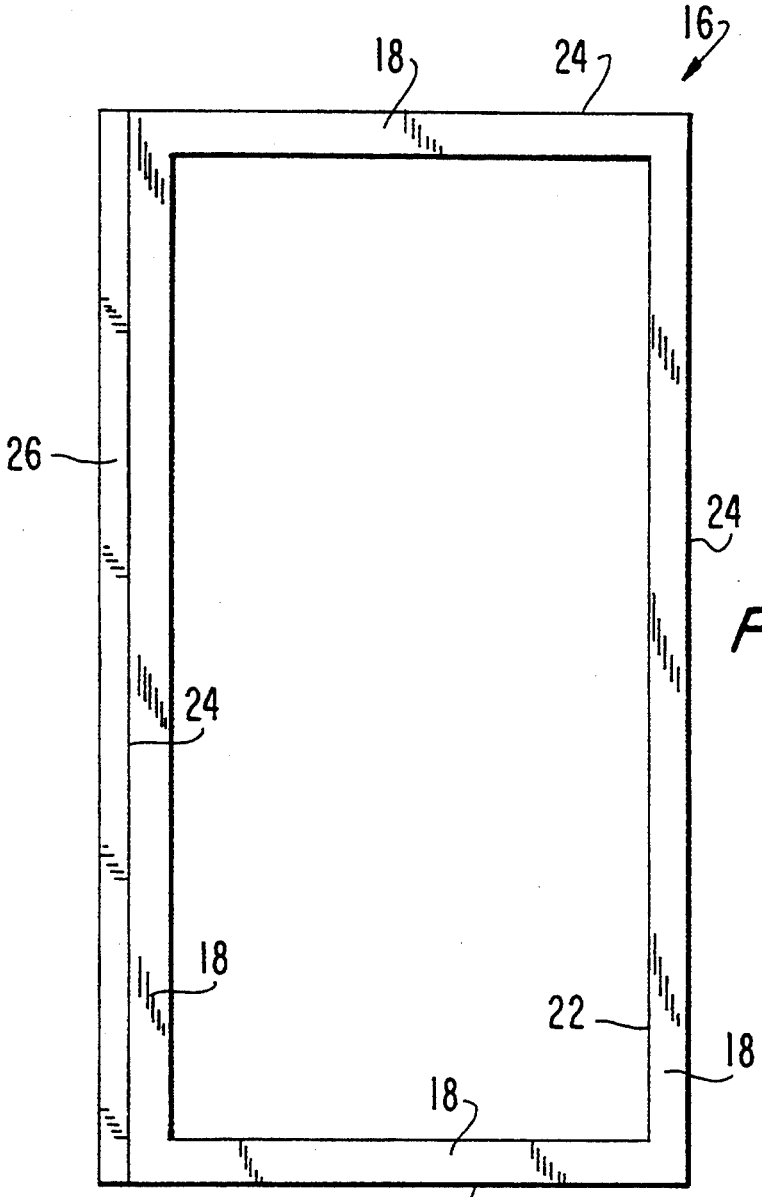
FIG. 2 is a front-elevational view of a structure in accordance with another embodiment of this invention for use within the wall unit of FIG. 1.
Figure 3:
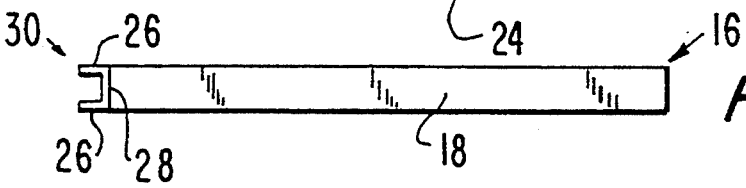
FIG 3 is a top plan view of the structure of FIG. 2.

Reference numeral 10 in FIG. 1 generally identifies a covered wall unit comprising an upright structure which, in this embodiment, is a solid, one-piece, rigid, generally rectangular panel 12 having opposite, generally planar, major surfaces and a plurality of outer, peripheral, generally planar edges, one of which is identified by reference numeral 14. Reference number 20 in FIG. 4 generally identifies another covered wall unit and comprises an upright structure which, in that embodiment, is a generally rectangular, apertured frame 16 (see FIGS. 2 and 3) having a plurality of frame elements 18 bounding a central opening 22 extending through the frame. Frame 16 also has outer, peripheral, generally planar edges, each identified by reference numeral 24.

Returning to FIG. 1, a channel-shaped, rigid, border element 30 is mounted on, and extends along, edge 14 of the panel 12. The element 30 has a pair of spaced-apart arms 26 in mutual parallelism and a web 28 extending between the arms. The web 28 is fastened to and along the peripheral edge 14, preferably by threaded fasteners. The element 30 has a generally flattened U-shaped cross-section, with the arms 26 and the web 28 bounding an outer, peripheral, open channel 32.

The panel 12 and attached element 30 are inserted into an oversized, tubular-shaped cover 34 constituted of a flexible material, such as fabric or foil. The cover 34, also known as a bag or sock, loosely surrounds the panel 12 and overlies the channel 32. The inner diameter of the cover 34 is designed to be larger than the outer dimensions of the panel 12 in order to provide for an easy, free insertion of the panel into the cover without ripping the cover.

Since the fit of the cover 34, at this stage of the manufacture, can be characterized as "baggy," tensioning means are provided, in accordance with this invention, for pushing the oversized, baggy cover into the channel 32, and for tensioning the cover to lie taut against the panel. Thus, tension bar 36 having a contour complementary to that of the channel 32 is moved in the direction of the arrow A into engagement with the cover 34 and, thereupon, into the channel 32, thereby tightly drawing the slack in the cover into the channel. The bar 36 is held in place either by friction or, preferably, by additional threaded fasteners 38 which are used to attach the bar 36 to the border element 30 and the panel 12. The bar 36 has an outer, generally planar, finish surface 40 which extends generally perpendicularly to the plane of the panel 12 for an aesthetic, custom fit. If the cover 34 has a seam, such as seam 42, then the seam is advantageously positioned in the channel 32 and, thereupon, when the bar 36 is inserted therein, the seam 42 is concealed, again contributing to an attractive appearance for the covered wall unit.

Figure 4:
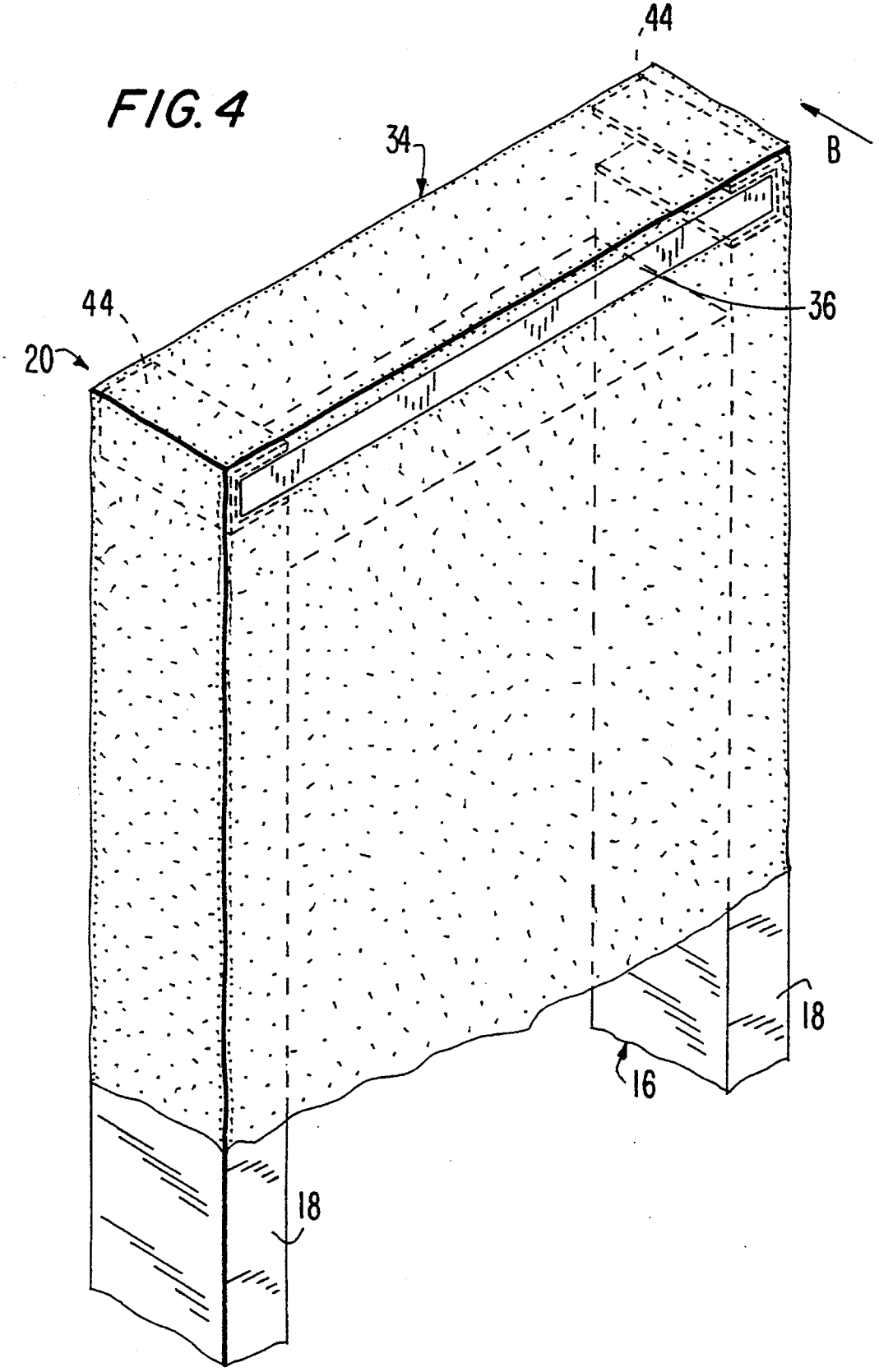
FIG. 4 is a view analogous to FIG. 1, but of another embodiment of this invention during its manufacture.

In FIG. 4, rather than a single border element running along the entire length of an outer edge of the structure, a pair of border elements 44 could be used. In this case, the two elements 44 face each other and together bound a sideways-open channel so that the tension bar 36 is inserted from the side in the direction of the arrow B. The cover 34 is stretched taut between the frame elements 18 as described above.

Although this invention has been illustrated by drawing slack portions of the cover at one side of a support structure, e.g., outer edge 14 in FIG. 1, or at the top of the support structure, e.g., top edge 24 in FIG. 4, it will be understood that, in some applications, more than one outer edge and, indeed, all of the outer edges of the support structure could be provided with an open channel in which a tensioning means is inserted.

It will be understood that each of the elements described above, or two or more together, also may find a useful application in other types of constructions differing from the types described above.

While the invention has been illustrated and described as embodied in a covered wall unit and method of making same, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalents of the following claims.

What is claimed as new and desired to be protected by Letters Patent is set forth in the appended claims.

I claim:

1. A covered wall unit, comprising:
(a) an upright structure having an outer, peripheral, open channel;
(b) a tubular-shaped cover loosely surrounding the structure and overlying the channel; and
(c) tensioning means receivable in the channel, for pushing the cover into the channel, and for tensioning the cover to lie taut against the structure.

2. The wall unit according to claim 1, wherein the structure is a generally. rectangular, one-piece panel having opposite, generally planar, major surfaces.

3. The wall unit according to claim 1, wherein the structure is a generally rectangular, apertured frame having frame elements bounding a central opening extending through the frame.

4. The wall unit according to claim 1, wherein the structure has at least one peripheral elongated edge, and a channel-shaped border element mounted on, and extending along, said at least one edge; and wherein the tensioning means includes a tension bar insertable in the channel of the border element.

5. The wall unit according to claim 4, wherein the border element has a pair of spaced-apart arms and a web extending between the arms, said web being mounted on the structure, and said arms extending away from the structure.

6. The wall unit according to claim 4, wherein the border element has a pair of spaced-apart arms and a web extending between the arms, one of the arms being mounted on the structure.

7. The wall unit according to claim 4, wherein the structure lies in a plane, and wherein the bar has an outer planar surface that extends generally perpendicularly to said plane.

8. The wall unit according to claim 1, wherein the structure is constituted of a rigid material and has a quadrilateral shape, and wherein the cover is an oversized tube constituted of a flexible material.

9. The wall unit according to claim 1, wherein the cover is a sewn tube having a seam positioned in the channel.

10. A method of making a covered wall unit, comprising the steps of:
a) forming an outer, peripheral, open channel on an upright structure;
b) inserting the structure into an oversized tubular-shaped cover in order to loosely surround the structure and overlie the channel; and
c) tensioning the cover to lie taut against the structure by pressing a tensioning means against the cover and pushing the cover into the channel.

* * * * *